US007101229B2

(12) United States Patent
Tufano et al.

(10) Patent No.: US 7,101,229 B2
(45) Date of Patent: Sep. 5, 2006

(54) ADAPTER FOR MOGUL BASE OPEN FIXTURE LAMPS

(75) Inventors: Anthony Tufano, North Massapequa, NY (US); David B. Balaban, Hauppauge, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/173,290

(22) Filed: Jul. 1, 2005

(65) Prior Publication Data

US 2006/0019544 A1 Jan. 26, 2006

Related U.S. Application Data

(60) Provisional application No. 60/584,705, filed on Jul. 1, 2004.

(51) Int. Cl.
*H01R 25/00* (2006.01)

(52) U.S. Cl. ..... 439/642

(58) Field of Classification Search ..... 439/638–642, 439/645, 647, 236, 615, 667
See application file for complete search history.

(56) References Cited

U.S. PATENT DOCUMENTS 1,553,148 A * 9/1925 Donahue ..... 439/645
4,183,604 A * 1/1980 Tjornhom, Sr. ..... 439/300
4,683,402 A * 7/1987 Aubrey ..... 315/56
5,006,571 A * 4/1991 Kumar et al. ..... 523/120
5,380,214 A * 1/1995 Ortega, Jr. ..... 439/253
5,382,181 A * 1/1995 Ortiz ..... 439/628
5,731,663 A * 3/1998 Davis ..... 315/194
5,788,525 A * 8/1998 Newman et al. ..... 439/307
5,989,070 A * 11/1999 Al-Turki ..... 439/644
6,113,433 A * 9/2000 Al-Turki ..... 439/639
6,162,100 A * 12/2000 Al-Turki ..... 439/644
6,494,730 B1 * 12/2002 Yan ..... 439/226
6,746,260 B1 * 6/2004 Chudkosky et al. ..... 439/236

* cited by examiner

*Primary Examiner*—Tho D. Ta
*Assistant Examiner*—Larisa Tsukerman
(74) *Attorney, Agent, or Firm*—Paul J. Sutton

(57) ABSTRACT

A lamp adapter for receiving a lamp having a conductive threaded portion and an extension with a conductive contact electrically insulated from the conductive threaded portion. The lamp adapter has a body with a top portion and a bottom portion. The top portion has a socket with a threaded sleeve adapted to receive the threaded portion of the lamp, a first lead electrically connected to the threaded sleeve, a cavity located with respect to the threaded sleeve so as to receive the extension of the lamp when the lamp is threaded into the threaded sleeve, a metal contact arm located within the cavity so as to make electrical contact with the conductive contact of the lamp when the lamp is threaded into the threaded sleeve, and a second lead electrically connected to the metal contact arm. The bottom portion has a threaded portion suitable for threading into a mating lamp socket, the threaded portion being electrically insulated from the top portion. The lamp adapter includes a recess located within the cavity and a coil spring disposed with a lower portion within the recess and an upper portion above the recess and within the cavity, wherein the metal contact arm is located in cooperation with the coil spring so as to be biased thereon and make contact with the conductive contact of the lamp when the lamp is threaded into the threaded sleeve. The metal contact arm is located with the cavity so as not to make contact with a conductive electrical contact on a lamp not having an extension.

9 Claims, 7 Drawing Sheets

ADAPTER FOR MOGUL BASE OPEN FIXTURE LAMPS

CROSS-REFERENCE TO RELATED APPLICATIONS

This application claims filing priority of U.S. provisional patent application Ser. No. 60/584,705, filed on Jul. 1, 2004 now abandoned.

BACKGROUND OF THE INVENTION

1. Field of the Invention

The present invention pertains generally to adapters for mogul base open fixture lamps.

2. Description of the Related Art

Metal halide lamps include a relatively centrally located arc tube situated within the confines of an outer glass bulb. These arc tubes are conventionally made of quartz and operate at extremely high temperatures and relatively high pressures. Under certain undesirable conditions, a system failure or internal factors will result in a safety hazard being created, whereby a violent shattering of the arc tube will send hot glass and lamp parts into contact with the bulb glass which, in turn, will break, releasing the hot glass and lamp parts into the surrounding environment. Under such conditions, there is an obvious risk of severe personal injury, fire and/or property damage.

For this reason, normally such conventional metal halide unshrouded lamps are supported within what are referred to as "enclosed" fixtures whose structure is designed to contain violently released hot glass and lamps parts. A cover lens is used in such fixtures. In addition, significant reductions in such potential violent failures can be achieved by replacing the lamp before the rated end of the life of the lamp. Another conventional manner in which such potential violent failures are reduced includes the user's periodically turning off the lamp to permit its cooling, so that upon relighting, a non-violent or less violent lamp failure is facilitated.

Recent developments in the field of low wattage metal halide lamp technology affects both lamps and lampholders. Manufacturers of metal halide lamps are selling lamps for use in what are referred to as "open" fixture, in which the lamp is mounted such that it is exposed during its use. In order to reduce or eliminate the risks associated with violent lamp failures in non-enclosed environments, a newer metal halide shrouded lamp has been developed in which a relatively thick shroud of quartz is situated intermediate the arc tube and the outer bulb glass such that, it the event of a violent lamp failure of the type described above, the shroud is intended to intercept and contain the hot glass and lamp parts which would otherwise impact and possibly break the bulb glass. The intended result is a less expensive and equally safe lamp and fixture combination suitable for indoor commercial lighting applications such as offices and retail spaces, as well as other environments.

To prevent the use of conventional unshrouded lamps intended to be used in an "enclosed" fixture in an "open" fixture, the newer shrouded lamp is provided with a different type of base so that the shrouded lamps intended for an open" fixture can be rapidly identified and separated from unshrouded lamps that must be used in an "enclosed" fixture.

There is a need for a device that allows the use of new shrouded lamps with existing "enclosed" fixtures.

SUMMARY OF THE INVENTION

The instant invention provides a novel adapter which allows the use of new shrouded lamps with "enclosed" fixtures. The adapter includes a top portion that will accept and make electrical contact with the new shrouded lamps and accept but will not make electrical contact with the older unshrouded lamps. A bottom portion of the adapter is configured to be inserted into an "enclosed" fixture. This is achieved by providing a central well in the floor of the adapter to accept the extension of the new lamp base and providing an electrical contact in such well which can only be contacted by a lamp contact which is placed at the end of the lamp base extension. An unshrouded lamp, lacking this extension and contact on such extension, can not extend into and engage the contact in the well. The bottom portion includes a threaded sleeve that is compatible with the internal sleeve of an "enclosed" fixture or lampholder.

More specifically, the present invention is a lamp adapter for receiving a lamp having a conductive threaded portion and an extension with a conductive contact electrically insulated from the conductive threaded portion. The lamp adapter has a body with a top portion and a bottom portion. The top portion has a socket with a threaded sleeve adapted to receive the threaded portion of the lamp, a first lead electrically connected to the threaded sleeve, a cavity located with respect to the threaded sleeve so as to receive the extension of the lamp when the lamp is threaded into the threaded sleeve, a metal contact arm located within the cavity so as to make electrical contact with the conductive contact of the lamp when the lamp is threaded into the threaded sleeve, and a second lead electrically connected to the metal contact arm. The bottom portion has a threaded portion suitable for threading into a mating lamp socket, the threaded portion being electrically insulated from the top portion. The lamp adapter includes a recess located within the cavity and a coil spring disposed with a lower portion within the recess and an upper portion above the recess and within the cavity, wherein the metal contact arm is located in cooperation with the coil spring so as to be biased thereon and make contact with the conductive contact of the lamp when the lamp is threaded into the threaded sleeve. The metal contact arm is located with the cavity so as not to make contact with a conductive electrical contact on a lamp not having an extension.

BRIEF DESCRIPTION OF THE DRAWING

In the drawings in which similar elements are given similar reference characters.

DETAILED DESCRIPTION OF THE INVENTION

Figure 1:
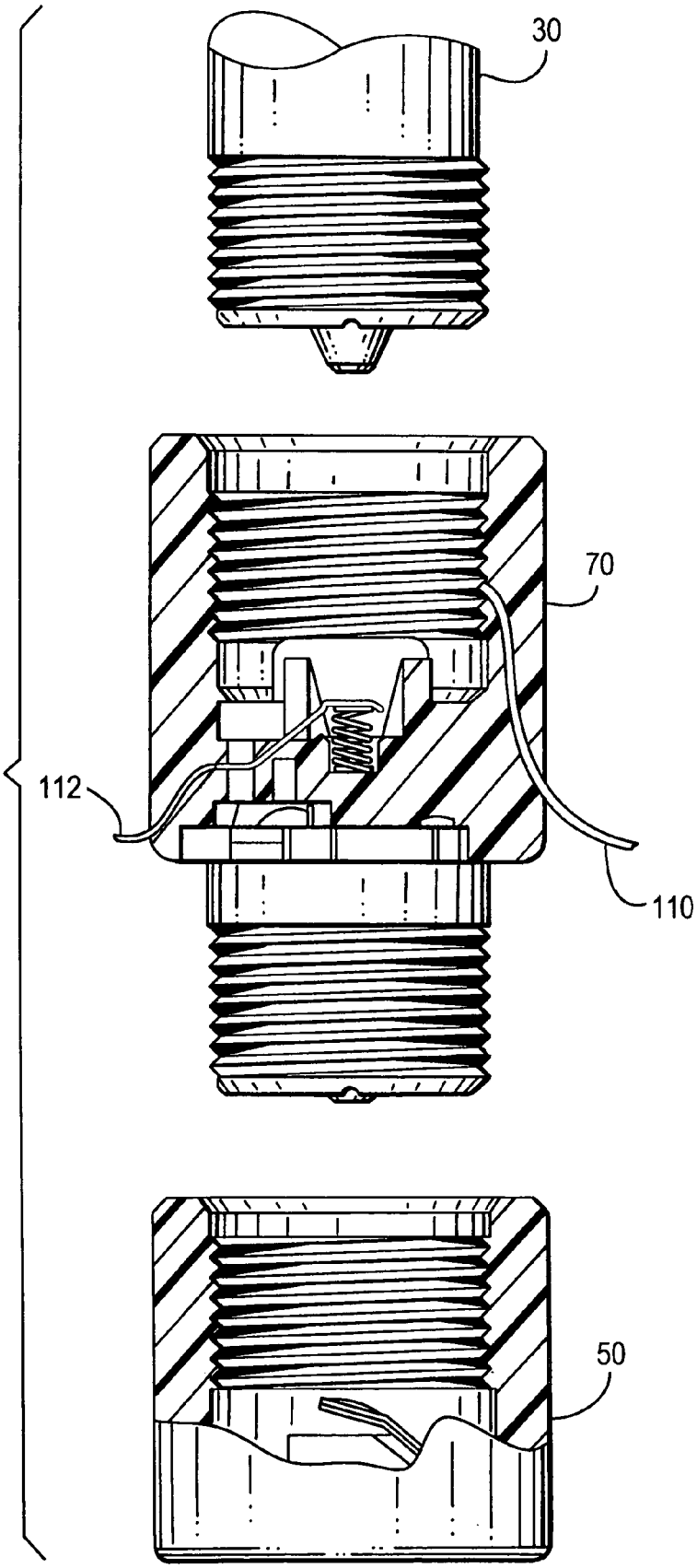
FIG. 1 is a front elevational view, partly cut-away and partly in section, of an adapter intended for connecting an "open" or shrouded lamp to an "enclosed" or unshrouded fixture according to an embodiment of the invention.
Figure 2:
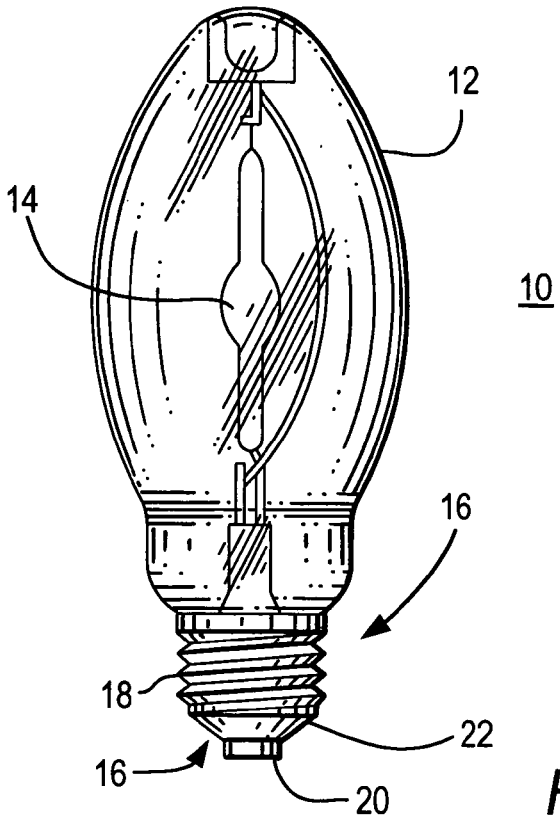
FIG. 2 PRIOR ART
FIG. 2 is a side elevational view of an unshrouded low wattage metal halide lamp intended for use in an "enclosed" fixture.

FIG. 1 shows an adapter 70 configured to allow an "open" or shrouded lamp 30 to be used with an "enclosed" fixture or lampholder 50 according to an embodiment of the invention. Adapter 70 includes a lampsocket body having a top portion configured to receive "open" lamp 30 and a bottom portion configured to be inserted into "enclosed" lampholder 50. The top portion provides an external electrical connection for lamp 30 via a pair of electrical wires 110, 112 for connection to an external power source that provides power to illuminate lamp 30. The bottom portion provides a means of mechanical support, but no electrical connection, for adapter 70. The structure and operation of adapter 70 are described in further detail below.

Referring to FIGS. 2, 4, 6 and 7, there is shown a typical low wattage metal halide lamp 10 and lampholder 50 for accepting and providing full electrical connection therewith. Lamp 10 has a glass bulb 12 within which is placed a quartz arc tube 14. Bulb 12 has a metal screw base 16 with the lower portion containing metal base threads 18. Any screw thread pattern can be chosen and the particular one shown is American Standard mogul threads, that is four threads per inch. The base 16 may be fabricated from any conductive metal such as copper or a copper alloy. A relatively flat contact 20, often termed a solder or button, also made of metal is mechanically but not electrically joined to the end of base 16 by an insulator 22, such as a non-conductive ceramic as is well known in the art. The base 16 is connected to one side of arc tube 14 while contact 20 is connected to the other.

Figure 6:
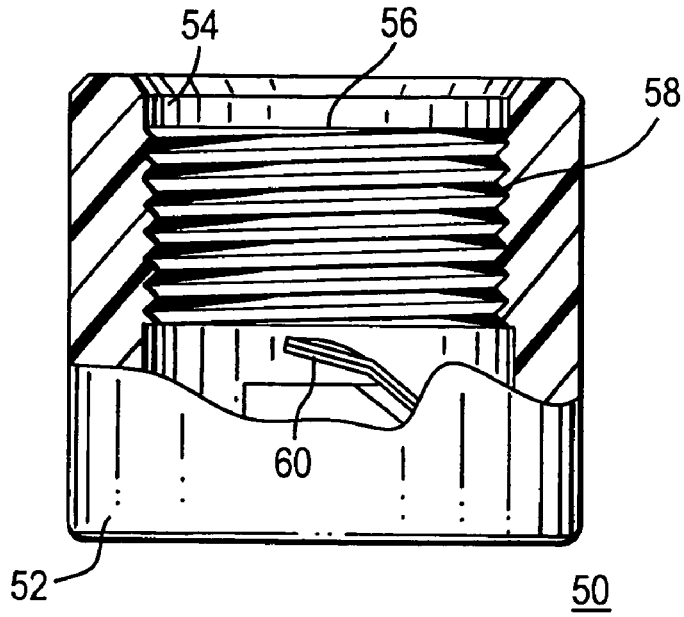
FIG. 6 PRIOR ART
FIG. 6 is a front elevational view, partly cut-away and partly in section, of a lampsocket body to receive and make electrical contact with an unshrouded, unprotected lamp.

FIG. 6 shows lampholder 50 having a body 52 of insulating material such as rubber, plastic, porcelain or the like. Socket 54 contains a metal sleeve 56 on which are formed threads 58 complementary to base threads 18 of lamp 10. A metal contact arm 60 is arranged to contact flat contact or button 20 of lamp 10 and is electrically insulated from metal sleeve 56. Metal sleeve 56 is connected to one conductor of an AC supply (not shown) while contact arm 60 is connected to the second of such conductors of the AC supply (not shown) to provide current to operate lamp 10.

Figure 3:
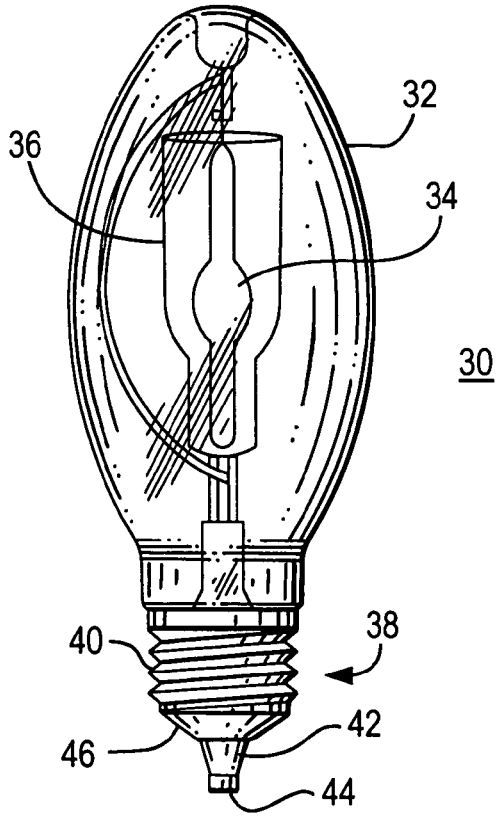
FIG. 3 PRIOR ART
FIG. 3 is a side elevational view of a shrouded low wattage metal halide lamp intended for use in an "open" fixture modified to show the new base used for these lamps.
Figure 4:
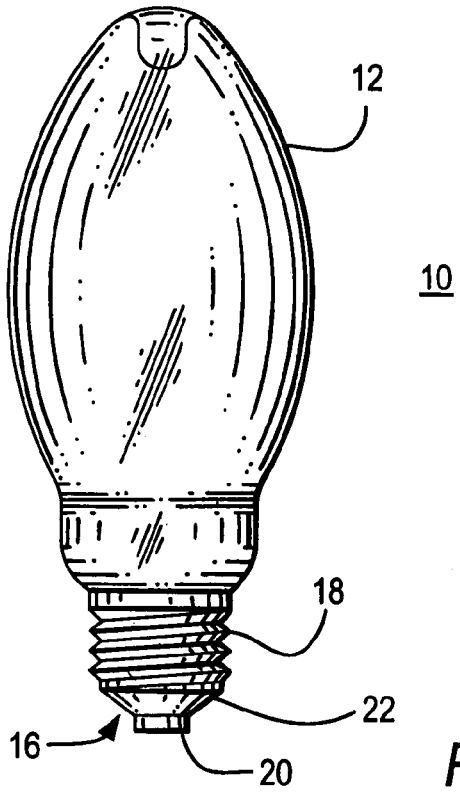
FIG. 4 PRIOR ART
FIG. 4 is a front elevational view of the lamp of FIG. 2.
Figure 5:
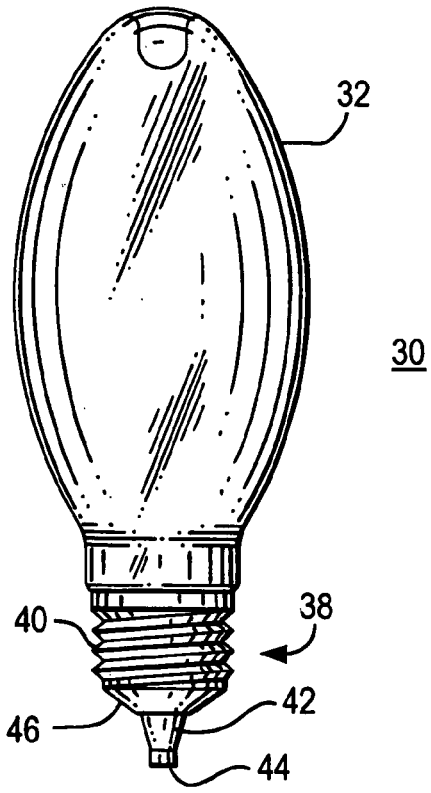
FIG. 5 PRIOR ART
FIG. 5 is a front elevational view of the lamp of FIG. 3.
Figure 7:
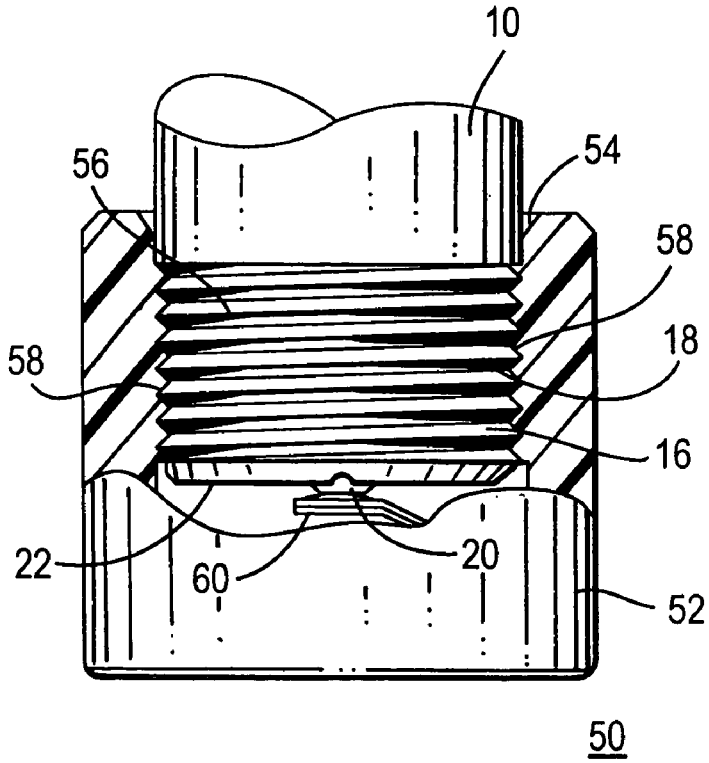
FIG. 7 PRIOR ART
FIG. 7 is the lampsocket of FIG. 6 with an unshrouded, unprotected lamp installed therein.
Figure 8:
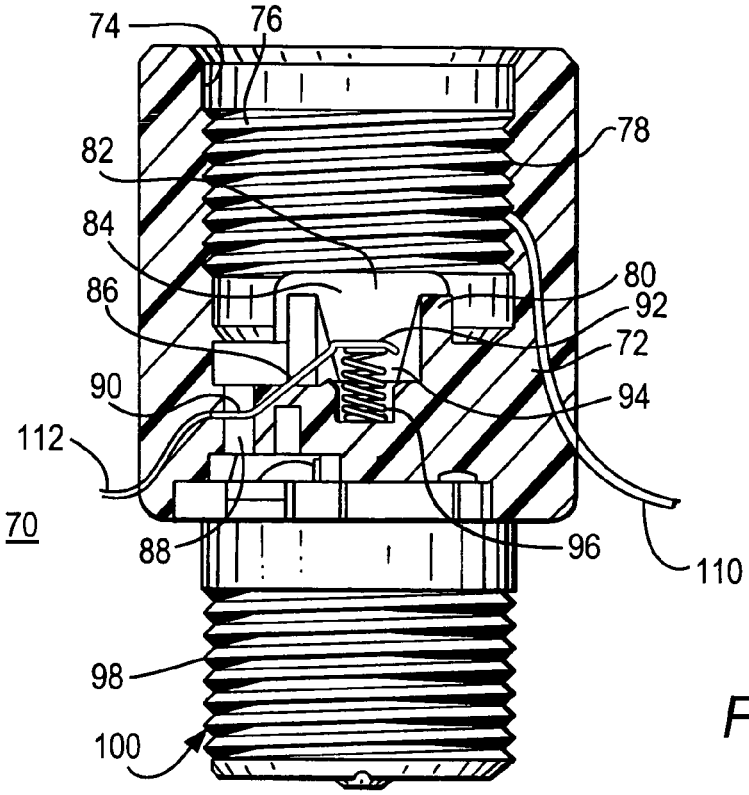
FIG. 8 is a front elevational view, in section, of an adapter constructed in accordance with the concepts of the invention.
Figure 10:
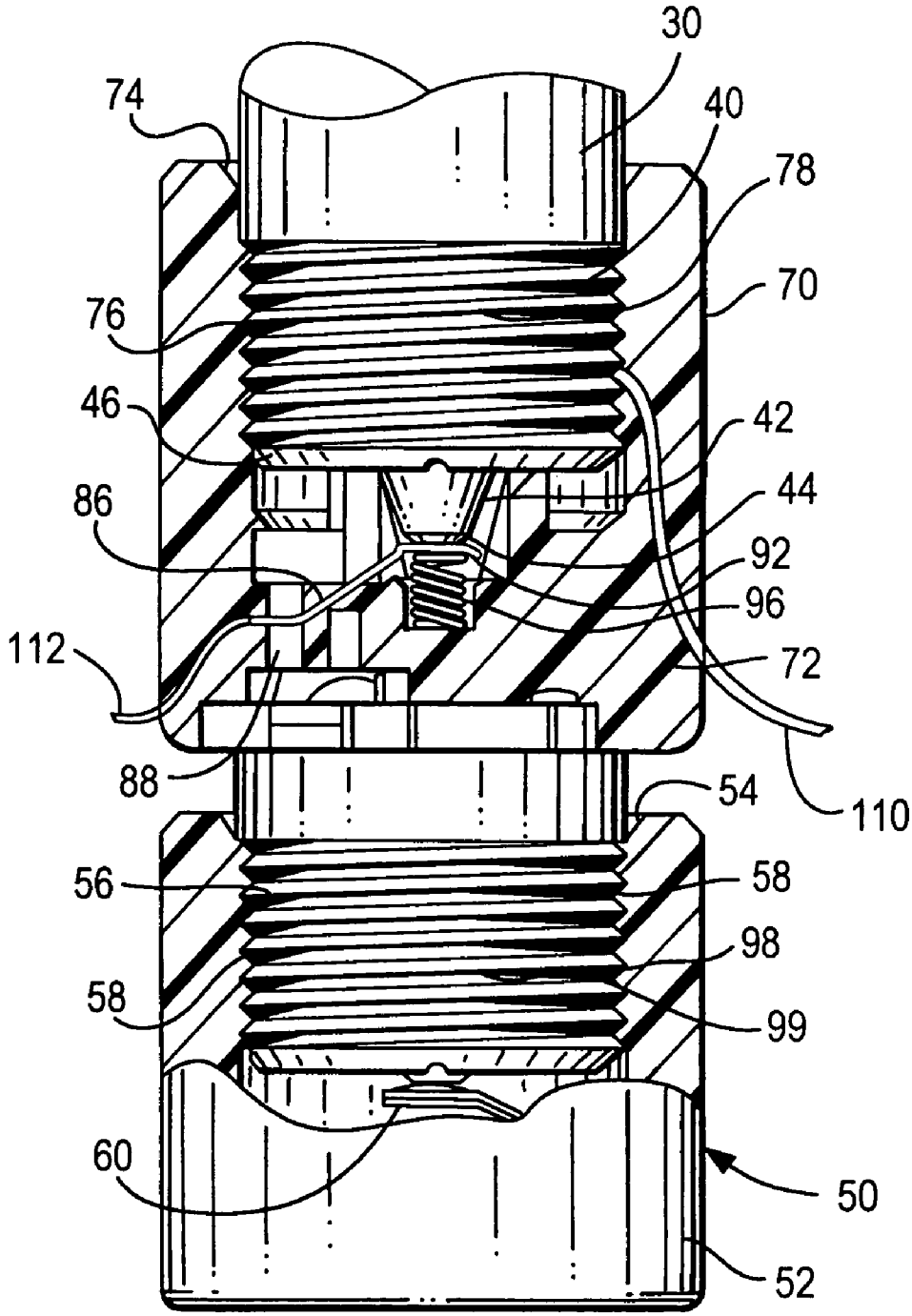
FIG. 10 is the adapter of FIG. 8, with a shrouded lamp positioned in and electrically connected thereby.

As shown in FIG. 7, lamp 10 has been inserted into lampholder 50 and metal base threads 18 advanced along metal socket threads 58 until button 20 makes solid contact with metal contact arm 60, allowing current to flow and lighting lamp 10. Shown in FIGS. 8 and 10 is adapter 70 constructed in accordance with the concepts of the invention. The top portion of adapter 70 is configured to accept and make electrical contact with a shrouded lamp base as shown in FIGS. 3 and 5 to which reference is now made. Lamp 30 is a low wattage metal halide lamp intended for use in an "open" fixture. In addition to glass bulb 32 and quartz arc tube 34 there is a shroud 36 of thick quartz positioned about arc tube 34. The metal screw base 38 has metal base threads 40 on its lower portion. An extension 42 of insulating material joins metal button 44 to screw base 38 via an insulating flange 46. Again one side of the arc tube 34 is connected to metal screw base 38 while the other side is connected to button 44.

The body 72 of adapter 70 (see FIG. 8) is fabricated from insulating material. Body 72 includes a socket 74 which contains a metal sleeve 76 on which are formed threads 78 complementary to base threads 40 of lamp 30. Sleeve 76 has a central raised hub 80 which has an aperture 82 in its center. Directly below aperture 82 is a cavity 84 in body 72. A metal contact arm 86 is cantilever mounted to a post 88 at a first end 90 and the free end 92 extends into cavity 84 below the aperture 82. A recess 94 in the floor of cavity 84 receives one end of a coil spring 96 whose other end engages the underside of contact arm 86 at free end 92. Coil spring 96 urges metal contact arm 86 upwardly against button 44 of lamp 30 when lamp 30 is positioned in lampholder 70.

The bottom portion of adapter 70 is configured to be inserted into unshrouded lamp socket as shown in FIG. 6 and to which reference is now made. The bottom portion of adapter 70 includes a sleeve 98 with threads 100 for threadably engaging the threaded sleeve of lamp socket 50. Any screw thread pattern can be chosen for threads 100 and the particular one shown is American Standard mogul threads, that is four threads per inch. Sleeve 98 may be fabricated from any conductive metal such as copper or a copper alloy. Alternatively, since adapter 70 does not need to make electrical contact with lampsocket 52, sleeve 98 can be made of insulative material such as a non-conductive ceramic as is well known in the art.

Lamp 30 is placed in cavity 74 of lampholder 70 and threads 40 made to advance along internal threads 78 by rotating lamp 30. Extension 42 enters the aperture 82 in hub 80 and button 44 engages contact arm 86. A good electrical contact between button 44 and arm 86 is assured by the coil spring 96 which urges arm 86 into contact with button 84. The insulating flange 46 contacts hub 80 about aperture 82 and limits downward insertion of lamp 30. Post 88 is connected to one supply conductor (electrical wire 112) while sleeve 76 is connected to the other (electrical wire 110) to supply current to lamp 30 from an external power source (not shown). An example of an external power source includes a remote mounted ballast system that provides alternating current (AC) power.

Adapter 70 is then placed into lampsocket 52 and threads 100 are advanced along 20 metal socket threads 58 until the adapter can no longer be advanced. Adapter 70 does not have to make contact with metal contact arm 60 since adapter 70 does not derive current from lampsocket 52.

Figure 9:
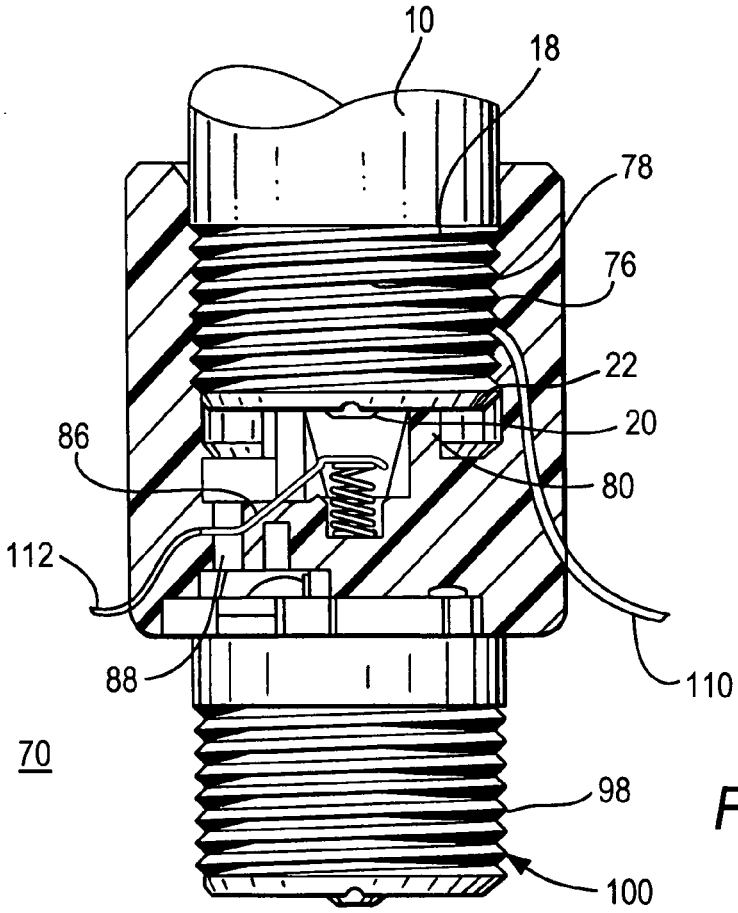
FIG. 9 is the adapter of FIG. 8, with an unshrouded, unprotected lamp positioned in but not electrically connected thereby.

In the event that one tries to employ a lamp 10 in a lampholder 70, the following occurs as is shown in FIG. 9. Threads 18 of lamp 10 engage threads 78 of sleeve 76 and lamp 10 advances until insulator 22 comes to rest upon hub 80, Contact 20 extends into aperture 82 to cavity 84. However, because of the absence of any extension similar to extension 42, the contact 20 is spaced quite a distance above contact arm 86 and no electrical contact is made. Accordingly, lamp 10 cannot be supplied with the current required to light the lamp 10.

Figure 11:
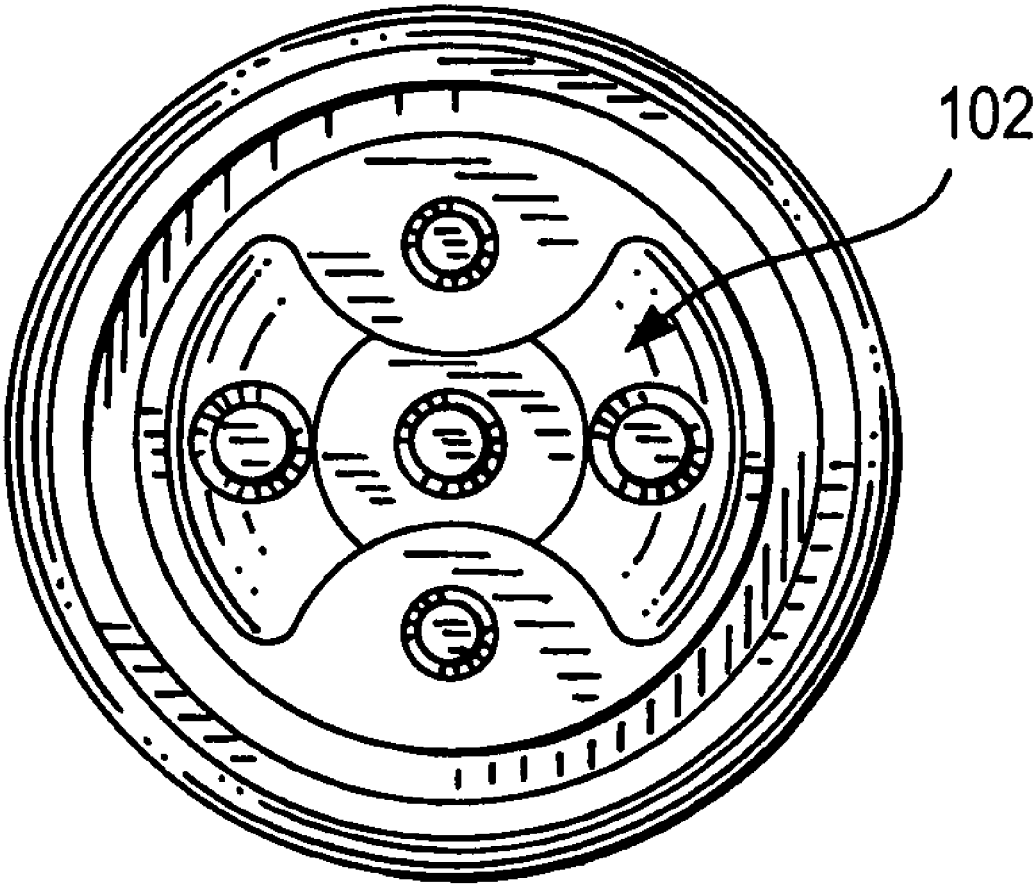
FIG. 11 is a bottom view of the adapter of FIG. 8.

FIG. 11 is a bottom view of adapter 70. Opening 102 may be shaped so as to allow contact 60 of lampholder 50 (see FIG. 10) to extend through the opening without making electrical contact with any portion of adapter 70. As explained above, lampholder 50 does not provide an electrical connection for adapter 70 so it is not necessary for contact 60 to make electrical contact with adapter 70.

Thus adapter 70 allows the use of "open" lamps with "enclosed" fixture lampholders. In addition, adapter 70 only accepts and electrically connect lamps 30 having the extension 42 indicative of a lamp intended for "open" fixture use, and accepts but does not electrically connect lamps 10 intended for "enclosed" fixtures.

While there have been shown and described and pointed out the fundamental novel features of the invention as applied to the preferred embodiment, it will be understood that various omissions and substitutions and changes of the form and details 20 of the device illustrated and in its operation may be made by those skilled in the art, without departing from the spirit of the invention.

What is claimed is:

1. A lamp adapter for receiving a lamp having a conductive threaded portion and an extension with a conductive contact electrically insulated from said conductive threaded portion, comprising a body comprising:

a. a top portion comprising:

i. a socket with a threaded sleeve adapted to receive the threaded portion of the lamp;

ii. a first lead electrically connected to said threaded sleeve;

iii. a cavity located with respect to the threaded sleeve so as to receive the extension of the lamp when the lamp is threaded into the threaded sleeve;

iv. a metal contact arm located within the cavity so as to make electrical contact with the conductive contact of the lamp when the lamp is threaded into the threaded sleeve; and v. a second lead electrically connected to said metal contact arm; and b. a bottom portion comprising a threaded portion suitable for threading into a mating lamp socket, said threaded portion being electrically insulated from the top portion.

2. The lamp adapter of claim 1 further comprising:

a recess located within said cavity;

a coil spring disposed with a lower portion within said recess and an upper portion above said recess and within said cavity;

wherein said metal contact arm is located in cooperation with said coil spring so as to be biased thereon and make contact with the conductive contact of the lamp when the lamp is threaded into the threaded sleeve.

3. The lamp adapter of claim 2 wherein said metal contact arm is located with said cavity so as not to make contact with a conductive electrical contact on a lamp not having an extension.

4. The lamp adapter of claim 1 wherein said cavity is defined by a raised hub.

5. The lamp adapted of claim 1 in which the body is an insulating material.

6. A lamp adapter for receiving a lamp having a conductive threaded portion and an extension with a conductive contact electrically insulated from said conductive threaded portion, comprising a body comprising:

a. a top portion comprising:

i. means for receiving the threaded portion of the lamp;

ii. first means for providing electrical current to the means for receiving the threaded portion of the lamp;

iii. means for receiving the extension of the lamp when the lamp is threaded into the means for receiving the threaded portion of the lamp;

iv. means for contacting the conductive contact of the lamp when the lamp is threaded into the means for receiving the threaded portion of the lamp; and v. second means for providing electrical current to the means for contacting the conductive contact of the lamp; and b. a bottom portion comprising a threaded portion suitable for threading into a mating lamp socket, said threaded portion being electrically insulated from the top portion.

7. The lamp adapter of claim 6 wherein said means for receiving the threaded portion of the lamp comprises a socket with a threaded sleeve adapted to receive the threaded portion of the lamp.

8. The lamp adapter of claim 7 wherein the means for receiving the extension of the lamp when the lamp is threaded into the means for receiving the threaded portion of the lamp comprises a cavity located with respect to the threaded sleeve so as to receive the extension of the lamp when the lamp is threaded into the threaded sleeve.

9. The lamp adapter of claim 8 wherein the means for contacting the conductive contact of the lamp when the lamp is threaded into the means for receiving the threaded portion of the lamp comprises a metal contact arm located within the cavity so as to make electrical contact with the conductive contact of the lamp when the lamp is threaded into the threaded sleeve.

* * * * *

UNITED STATES PATENT AND TRADEMARK OFFICE

CERTIFICATE OF CORRECTION

PATENT NO. : 7,101,229 B2
APPLICATION NO. : 11/173290
DATED : September 5, 2006
INVENTOR(S) : Anthony Tufano and David B. Balaban It is certified that error appears in the above-identified patent and that said Letters Patent is hereby corrected as shown below:

Column 6, line 3 (claim 5), "adapted" should read --adapter--

Signed and Sealed this

Twelfth Day of June, 2007

JON W. DUDAS
*Director of the United States Patent and Trademark Office*